US007278819B2

(12) United States Patent
Schilling

(10) Patent No.: US 7,278,819 B2
(45) Date of Patent: Oct. 9, 2007

(54) VARIABLE STATOR VANE LEVER ARM ASSEMBLY AND METHOD OF ASSEMBLING SAME

(75) Inventor: Jan Christopher Schilling, Middletown, OH (US)

(73) Assignee: General Electric Company, Schenectady, NY (US)

( * ) Notice: Subject to any disclaimer, the term of this patent is extended or adjusted under 35 U.S.C. 154(b) by 136 days.

(21) Appl. No.: 11/174,745

(22) Filed: Jul. 5, 2005

(65) Prior Publication Data

US 2007/0048126 A1 Mar. 1, 2007

(51) Int. Cl.
*F04D 29/56* (2006.01)

(52) U.S. Cl. ..... 415/147; 415/160

(58) Field of Classification Search ..... 415/147, 415/150, 156, 159, 160, 209.2, 209.3
See application file for complete search history.

(56) References Cited

U.S. PATENT DOCUMENTS

| | | | | |
|---|---|---|---|---|
| 3,736,070 | A * | 5/1973 | Moskowitz et al. | 415/147 |
| 4,275,560 | A | 6/1981 | Wright et al. | |
| 4,978,280 | A * | 12/1990 | Tubbs | 415/159 |
| 5,061,152 | A * | 10/1991 | Marey | 415/150 |
| 5,096,374 | A * | 3/1992 | Sakai et al. | 415/150 |
| 5,492,446 | A | 2/1996 | Hawkins et al. | |
| 5,622,473 | A | 4/1997 | Payling | |
| 5,796,199 | A * | 8/1998 | Charbonnel | 310/90 |
| 5,807,072 | A | 9/1998 | Payling | |
| 6,019,574 | A | 2/2000 | DiBella | |
| 6,209,198 | B1 | 4/2001 | Lammas et al. | |
| 6,474,941 | B2 | 11/2002 | Dingwell et al. | |
| 6,767,183 | B2 | 7/2004 | Schilling et al. | |
| 6,843,638 | B2 * | 1/2005 | Hidalgo et al. | 415/209.3 |

FOREIGN PATENT DOCUMENTS

FR 2599785 A * 12/1987

* cited by examiner

*Primary Examiner*—Igor Kershteyn
(74) *Attorney, Agent, or Firm*—William Scott Andes; Armstrong Teasdale LLP

(57) ABSTRACT

A variable stator vane assembly for a gas turbine engine including an actuation ring including an upper surface, a lower surface, a first side, a second side, and at least one recess that is defined between the upper surface, the lower surface, the first side, and the second side, a plurality of variable stator vanes, and a lever arm assembly coupled between the actuation ring and at least one of the variable stator vanes, the lever arm assembly including an articulating block inserted at least partially into the actuation ring recess such that the articulating block is movable in a first axis; and a lever arm coupled to the articulating block and at least one of the variable stator vanes such that the lever arm is movable in a second axis that is different than the first axis.

20 Claims, 7 Drawing Sheets

VARIABLE STATOR VANE LEVER ARM ASSEMBLY AND METHOD OF ASSEMBLING SAME

BACKGROUND OF THE INVENTION

This invention relates generally to gas turbine engine variable stator vane assemblies and, more particularly, to an articulating lever arm assembly used with a variable stator vane assembly.

Gas turbine engines include a high pressure compressor, an intermediate pressure compressor, a combustor, a high pressure turbine, and an intermediate pressure turbine. The intermediate and high pressure compressors each include a rotor, and a plurality of stages. The rotor is surrounded by a casing, and each stage includes a row of rotor blades and a row of stator vanes. The casing supports the stator vanes, and the rotor supports the rotor blades. The stator vane rows are between the rotor blade rows and direct air flow toward a subsequent downstream rotor blade row.

At least some known gas turbine engines include at least one variable stator vane assembly that is utilized to control the quantity of air flowing through the compressor to facilitate optimizing performance of the compressor. The variable stator vane assembly includes a plurality of variable stator vanes which extend between adjacent rotor blades. The variable stator vanes are rotatable about an axis such that the stator vanes are positionable in a plurality of orientations to direct air flow through the compressor.

At least one known variable stator vane assembly includes a plurality of variable stator vanes that are each coupled to a respective actuation ring or synchronous ring. More specifically, each variable stator vane is coupled to the actuation ring utilizing a simple lever arm apparatus. For example, at least one known variable stator vane assembly includes a lever having two ends. The first lever end is coupled to a respective stator vane, and the second lever end is coupled to the actuation ring. The second lever end includes a fixed pin, i.e. a pin that is fixedly coupled to the lever second end using a welding or brazing procedure for example. The pin is inserted into the actuation ring and is surrounded by a known journal bushing. During operation, the actuation ring is translated around the engine rotation axis, and the lever arm, coupled between the stator vane and the actuation ring, is moved around an axis that is normal to the engine axis. Since the pin is fixedly coupled to the actuation ring, the rotation of the ring and lever arm creates a moment on the pin that increases torque around the lever arm, thus generating relatively high stresses at the pin end, bushing distress, and/or eventual breakage of the pin.

BRIEF SUMMARY OF THE INVENTION

In a first aspect, a method for assembling a variable stator vane assembly is provided. The variable stator vane assembly includes an actuation ring, a plurality of variable stator vanes, and a lever arm assembly coupled between the actuation ring and at least one variable stator vane. The lever arm assembly includes a lever arm and an articulating block, the actuation ring including an upper surface, a lower surface, a first side, and a second side. The method includes inserting an articulating block at least partially into a first recess formed within the actuation ring such that the articulating block is movable in a first axis, and coupling the articulating block to the lever arm such that the lever arm is movable in a second axis that is different than the first axis.

In another aspect, a variable stator vane assembly is provided. The variable stator vane assembly includes an actuation ring including an upper surface, a lower surface, a first side, a second side, and at least one recess that is defined between the upper surface, the lower surface, the first side, and the second side; a plurality of variable stator vanes; and a lever arm assembly coupled between the actuation ring and at least one of the variable stator vanes. The lever arm assembly includes an articulating block inserted at least partially into the actuation ring recess such that the articulating block is movable in a first axis, and a lever arm coupled to the articulating block and at least one of the variable stator vanes such that the lever arm is movable in a second axis that is different than the first axis.

In a further aspect, a gas turbine engine is provided. The gas turbine engine includes a compressor, a combustor, a turbine, and a variable stator vane assembly. The variable stator vane assembly includes an actuation ring including an upper surface, a lower surface, a first side, a second side, and at least one recess that is defined between the upper surface, the lower surface, the first side, and the second side; a plurality of variable stator vanes; and a lever arm assembly coupled between the actuation ring and at least one of the variable stator vanes. The lever arm assembly includes an articulating block inserted at least partially into the actuation ring recess such that the articulating block is movable in a first axis, and a lever arm coupled to the articulating block and at least one of the variable stator vanes such that the lever arm is movable in a second axis that is different than the first axis.

DETAILED DESCRIPTION OF THE INVENTION

Figure 1:
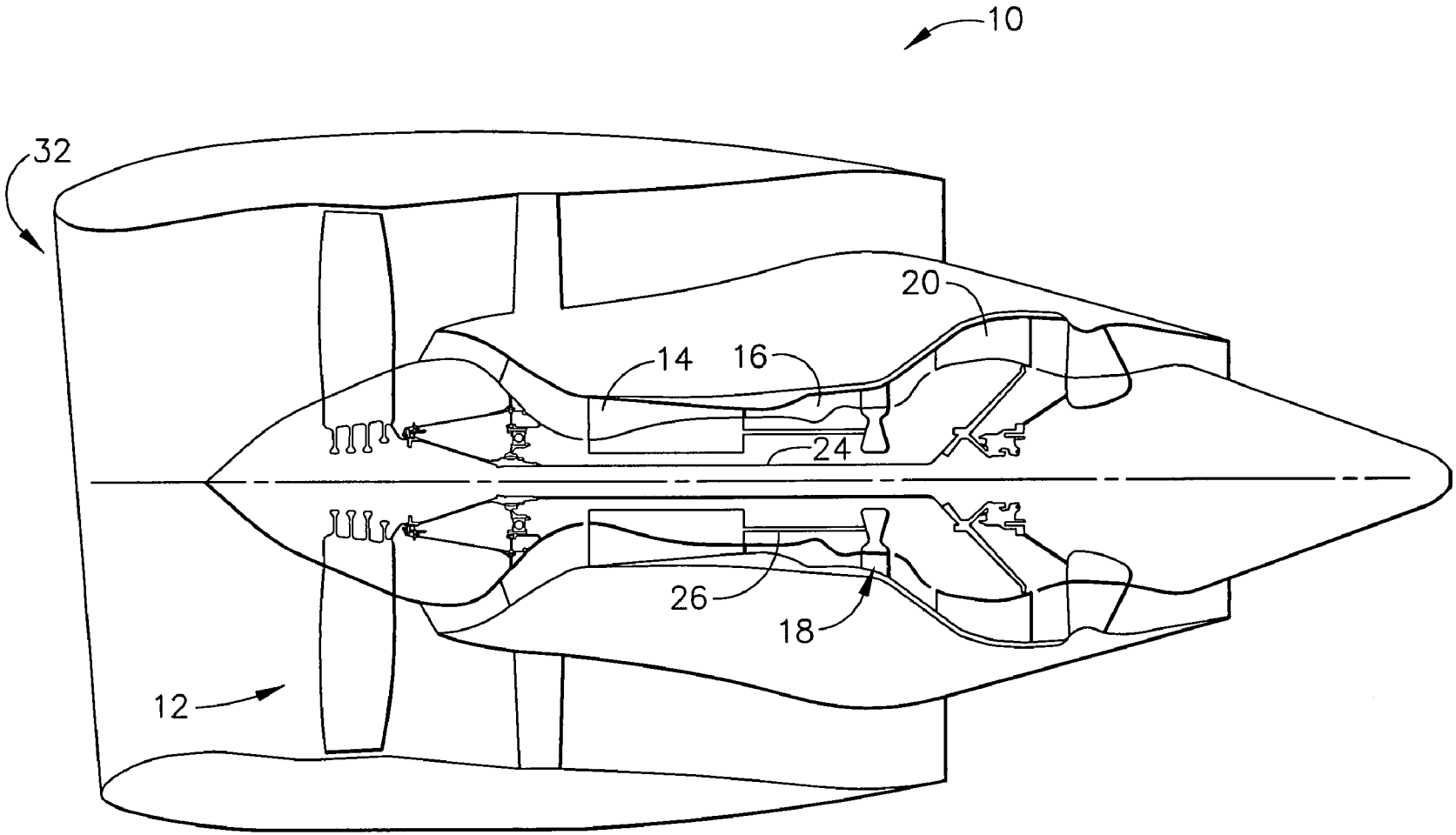
FIG. 1 is schematic illustration of an exemplary gas turbine engine.

FIG. 1 is a schematic illustration of a gas turbine engine 10 including a low, or intermediate, pressure compressor 12, a high pressure compressor 14, and a combustor assembly 16. Engine 10 also includes a high pressure turbine 18, and a low, or intermediate, pressure turbine 20 arranged in a serial flow relationship. Compressor 12 and turbine 20 are coupled by a first shaft 24, and compressor 14 and turbine 18 are coupled by a second shaft 26. In one embodiment, engine 10 is an LM6000 engine commercially available from General Electric Company, Cincinnati, Ohio.

In operation, air flows through low pressure compressor 12 from an upstream side 32 of engine 10 and compressed air is supplied from low pressure compressor 12 to high pressure compressor 14. Compressed air is then delivered to combustor assembly 16 where it is mixed with fuel and ignited. The combustion gases are channeled from combustor 16 to drive turbines 18 and 20.

Figure 2:
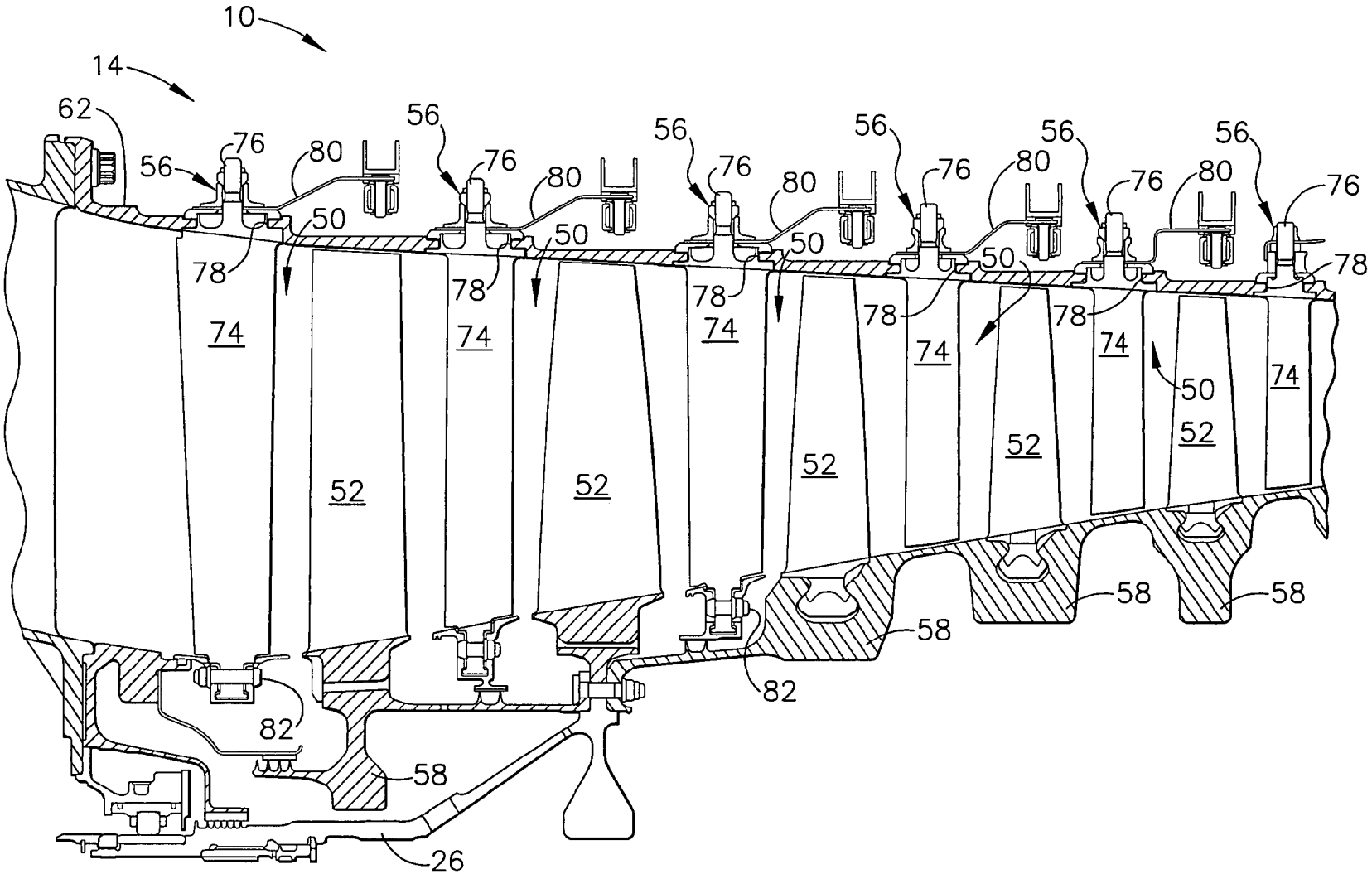
FIG. 2 is a schematic view of a section of the high pressure compressor used with the engine shown in FIG. 1.

FIG. 2 is a schematic view of a section of high pressure compressor 14. Compressor 14 includes a plurality of stages 50, wherein each stage 50 includes a row of rotor blades 52 and a row of variable stator vane assemblies 56. Rotor blades 52 are typically supported by rotor disks 58, and are connected to rotor shaft 26. Rotor shaft 26 is a high pressure shaft that is also connected to high pressure turbine 18 (shown in FIG. 1). Rotor shaft 26 is surrounded by a stator casing 62 that supports variable stator vane assemblies 56.

Each variable stator vane assembly 56 includes a plurality of variable vanes 74 each having a respective vane stem 76. Vane stem 76 protrudes through an opening 78 in casing 62. Each variable vane assembly 56 also includes a lever arm assembly 80 extending from variable vane 74 that is utilized to rotate variable vanes 74. Vanes 74 are oriented relative to a flow path through compressor 14 to control air flow therethrough. In addition, at least some vanes 74 are attached to an inner casing 82.

Figure 3:
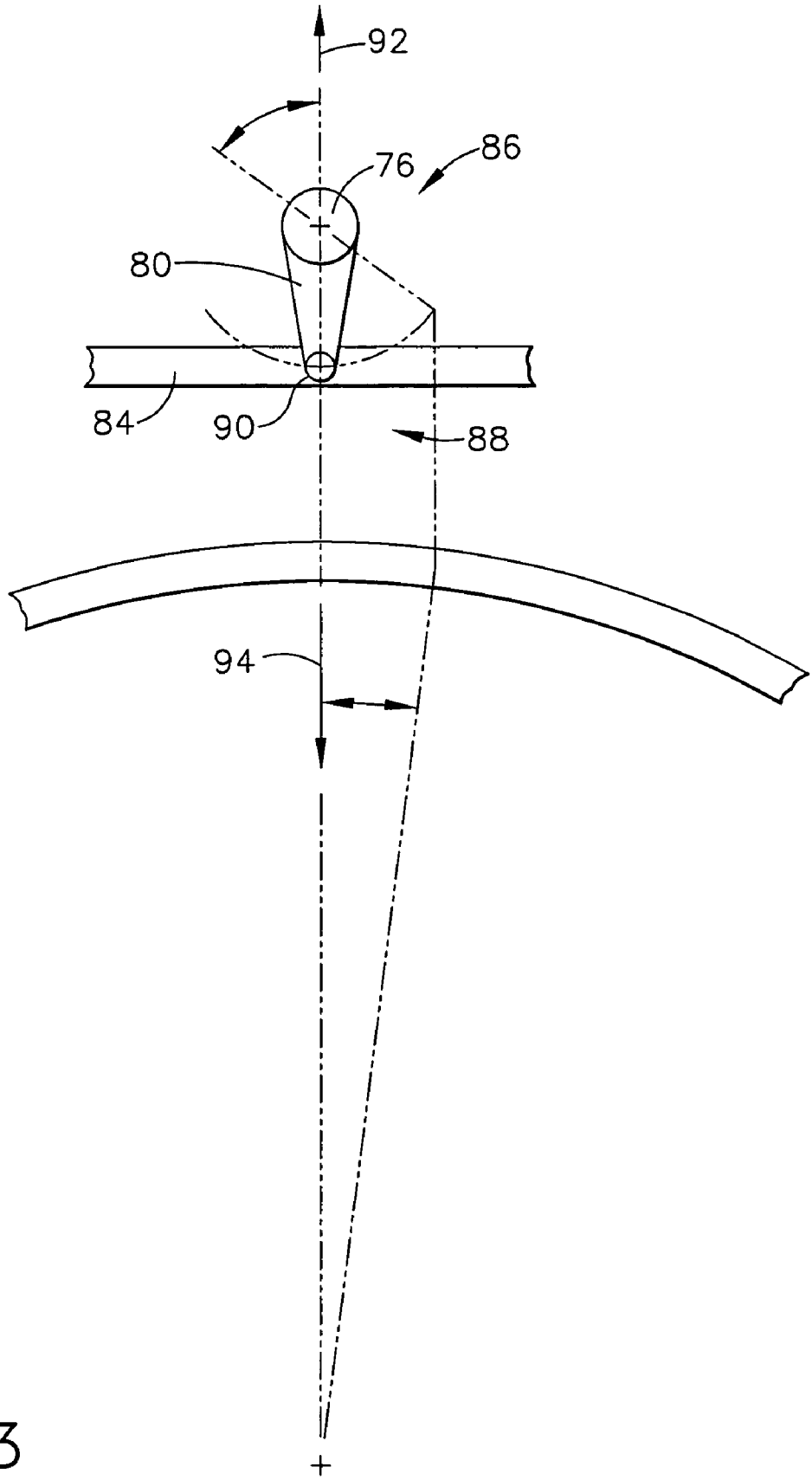
FIG. 3 is a schematic view of a portion of the variable stator vane assembly shown in FIG. 2.

FIG. 3 is a schematic illustration of a portion of variable stator vane assembly 56 shown in FIG. 2. In the exemplary embodiment, variable stator vane assembly 56 also includes a plurality of variable vanes 74 that are coupled to a respective actuation ring 84. More specifically, each variable vane 74 is coupled to actuation ring 84 utilizing lever arm assembly 80. In the exemplary embodiment, lever arm assembly 80 includes a first end 86 that is coupled to a respective variable vane 74, and a second end 88 that is coupled to actuation ring 84. More specifically, variable stator vane assembly 56 includes a pin 90 that facilitates coupling lever arm 80 to actuation ring 84. During operation, actuation ring 84 is translated around an engine rotation axis 92. Since lever arm 80 is coupled to actuation ring 84, translating actuation ring 84 about engine rotation axis 92 causes lever arm 80 to move vane stem 76, and thus variable vane 74 around an axis 94 normal to engine rotation axis 92. to facilitate positioning the plurality of variable vanes 74 in a plurality of orientations to direct air flow through compressor 14.

Figure 4:
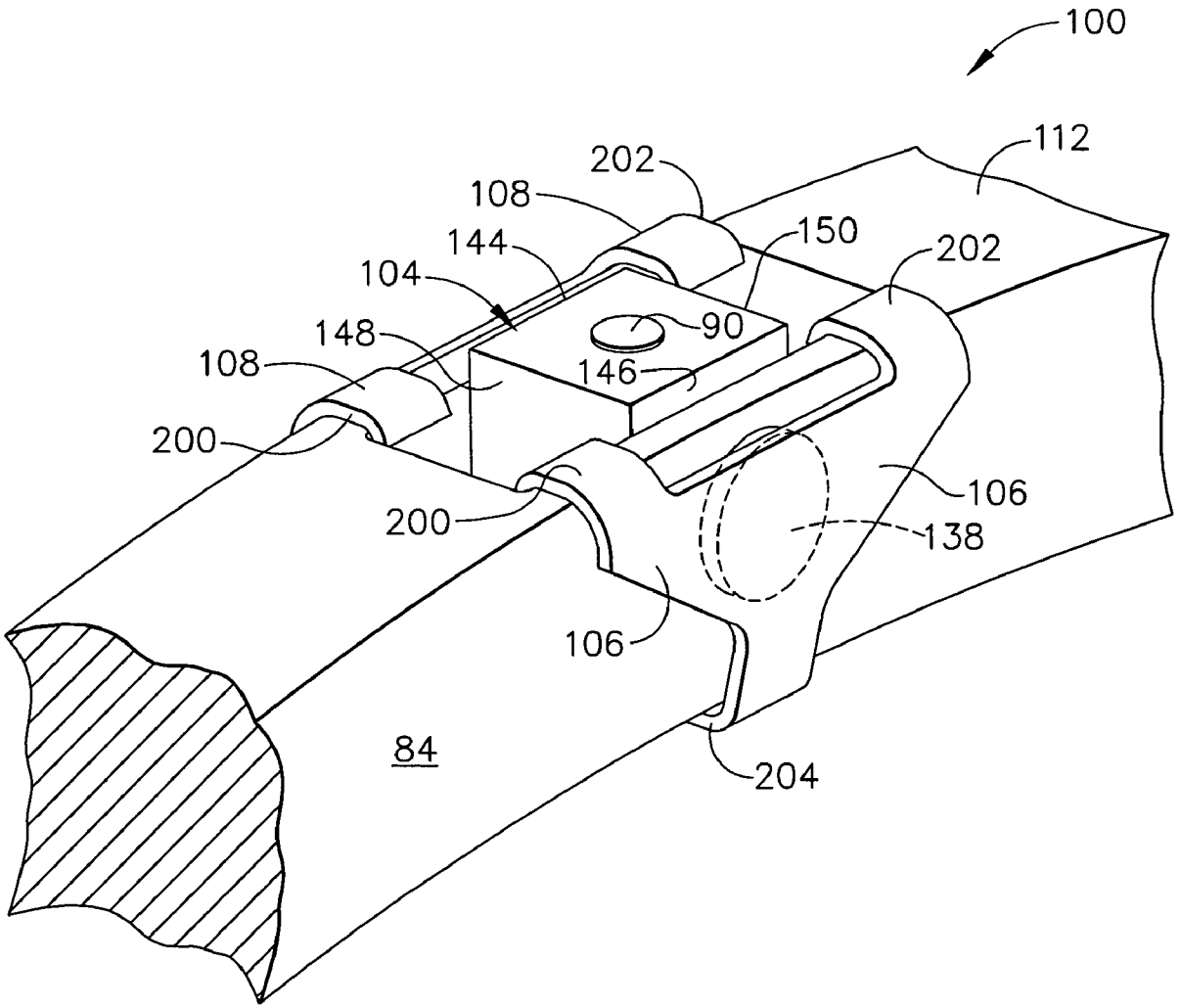
FIG. 4 is a perspective view of an exemplary articulating variable stator vane lever arm assembly.
Figure 5:
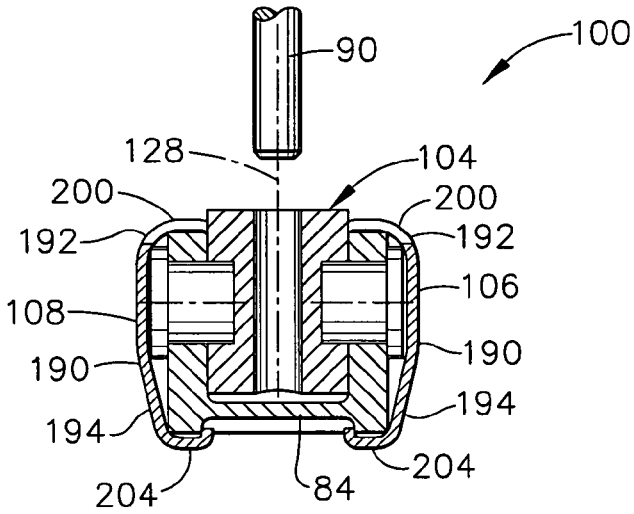
FIG. 5 is a cross-sectional view of a portion of the exemplary stator lever arm assembly shown in FIG. 4.
Figure 6:
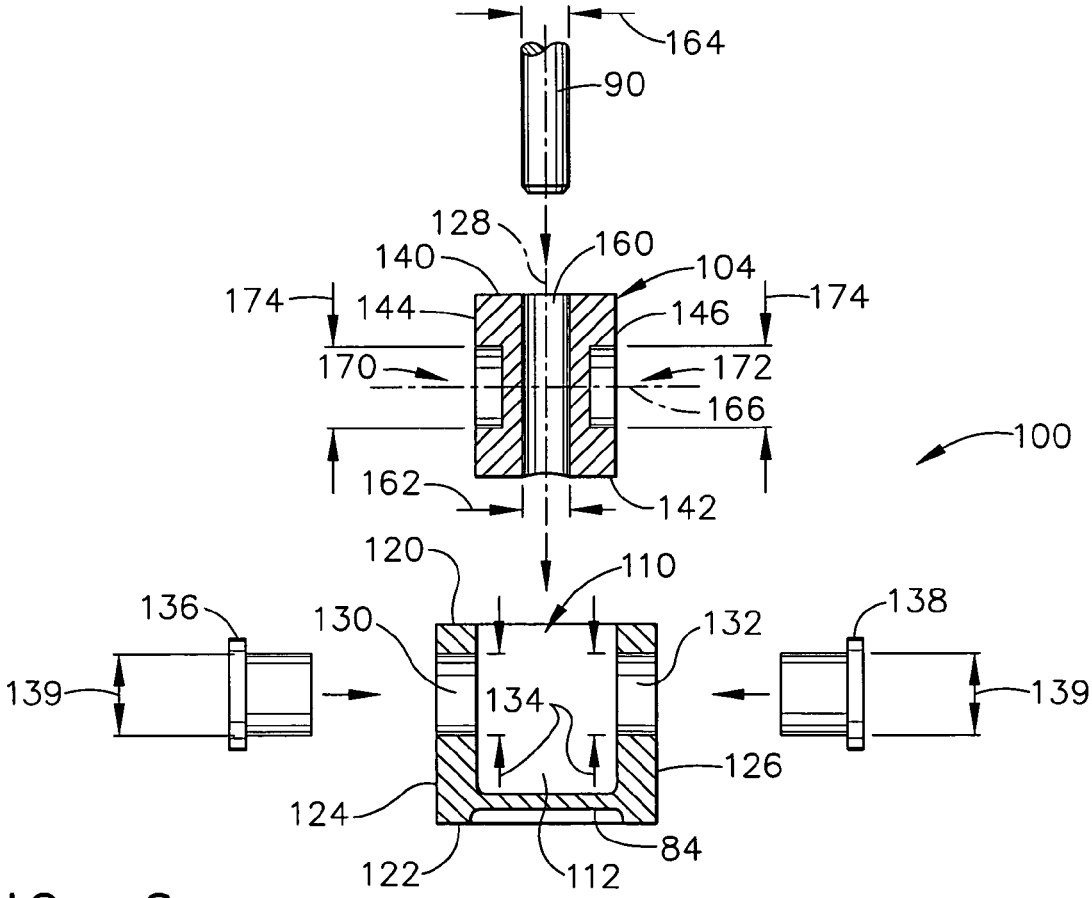
FIG. 6 is an exploded cross-sectional view of the exemplary stator lever arm assembly shown in FIG. 5.
Figure 7:
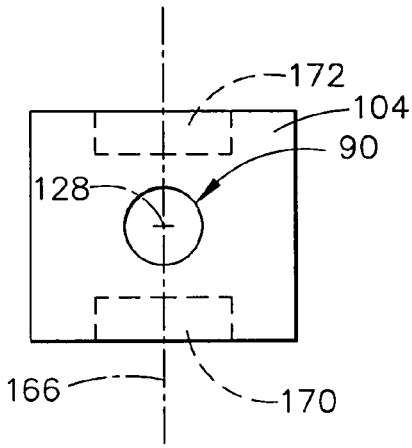
FIG. 7 is a top view of an articulating block shown in FIG. 5.
Figure 8:
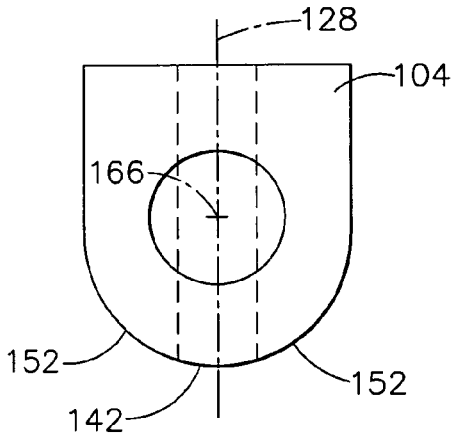
FIG. 8 is a side view of the articulating block shown in FIG. 7.

FIG. 4 is a perspective view of a portion of actuation ring 84 that includes an exemplary articulating variable stator vane lever arm assembly 100. FIG. 5 is a cross-sectional view of a portion of actuation ring 84 and lever arm assembly 100 shown in FIG. 4. FIG. 6 is an exploded cross-sectional view of the portion of actuation ring 84 and lever arm assembly 100 shown in FIG. 5. FIG. 7 is a top view of an articulating block 104. FIG. 8 is a side view of articulating block 104. Articulated, as used herein, is defined as a component that includes at least two portions with a moveable joint therebetween. In the exemplary embodiment, lever arm assembly 100 is coupled to actuation ring 84, and includes articulating block 104, a first retaining clip 106, and a second retaining clip 108. In the exemplary embodiment, actuation ring 84 is configured to reposition plurality of variable vanes 74 (shown in FIG. 2) in a plurality of orientations to direct air flow through compressor 14 (shown in FIG. 1). Although actuation ring 84 is shown including a single lever arm assembly 100, it should be realized that actuation ring 84 includes a plurality of lever arm assemblies 100 such that a plurality of variable vanes can be coupled to a plurality of respective actuation rings.

Actuation ring 84 includes a recess 110 formed therein that is selectively sized such that articulating block 104 can be at least partially inserted within recess 110. In the exemplary embodiment, recess 110 includes a substantially rectangular cross-sectional profile 112. In an alternative embodiment, recess 110 includes a cross-sectional profile that is not substantially rectangular. More specifically, actuation ring 84 includes an upper surface 120, a lower surface 122 that is opposite upper surface 120, a first side 124, and a second side 126 that is opposite first side 124. Accordingly, and in the exemplary embodiment, recess 110 extends along a substantially vertical axis 128 from upper surface 120 at least partially towards lower surface 122.

Actuation ring 84 also includes a first opening 130 that extends through first side 124 such that first opening 130 is defined between first side 124 and recess 110. Actuation ring 84 also includes a second opening 132 that extends through second side 126 such that second opening 132 is defined between second side 126 and recess 110. In the exemplary embodiment, first and second openings 130 and 132 each have a width 134 that are each sized to receive a respective retaining pin 136 and 138, therethrough. More specifically, retaining pins 136 and 138 each have a width 139 that is sized such that retaining pins 136 and 138 are frictionally coupled within respective openings 130 and 132. Moreover, width 139 is sized such that respective retaining pins 136 and 138, which provide the block articulating axis, are sufficiently large to facilitate absorbing the actuation loads.

Variable stator vane lever arm assembly 100 also includes articulating block 104. In the exemplary embodiment, articulating block 104 includes an upper surface 140, a lower surface 142 that is opposite upper surface 140, a first side 144, a second side 146 that is opposite first side 144, a third side 148, and a fourth side 150 that is opposite third side 148. Accordingly, and in the exemplary embodiment, articulating block 104 has a substantially rectangular cross-sectional profile that is substantially similar to the cross-sectional profile of recess 110. More specifically, articulating block 104 has a cross-sectional profile that is selected such that articulating block 104 can be positioned at least partially within recess 110 and move within recess 110. In the exemplary embodiment, articulating block 104 is fabricated from a thermoplastic polyimide material such as, but not limited to, Vespel, for example.

In the exemplary embodiment, articulating block 104 includes a first recess 160 that has a width 162. In the exemplary embodiment, first recess 160 extends from upper surface 140 along vertical axis 128 through at least a portion of articulating block 104 towards lower surface 142, and has a width 162 that is sized to receive pin 90 therein. Accordingly, width 162 is approximately equal to a width 164 of pin 90 such that a portion of pin 90 is frictionally coupled within recess 160. Articulating block 104 also includes a second recess 170 that extends from first side 144 at least partially through articulating block 104 along a substantially horizontal axis 166, i.e. an axis that is substantially perpendicular to vertical axis 128, and a third recess 172 that extends from second side 146 at least partially through articulating block 104 along horizontal axis 166. Accordingly, second and third recesses 170 and 172 are substantially aligned along the same horizontal axis 166. In the exemplary embodiment, as shown in FIG. 8, articulating block lower surface 142 includes two rounded edges such that at least a portion of lower surface has a substantially semi-circular shaped. More specifically, articulating block 104 is fabricated and/or machined such that at least a portion of articulating block lower surface 142 is rounded over to facilitate articulating block 104 moving and/or "rocking" within recess 110.

Variable stator vane lever arm assembly 100 also includes a first retaining clip 106 and second retaining clip 108. In the exemplary embodiment, retaining clips 106 and 108 each include a body portion 190 having a first end 192 and a second end 194 that is opposite to the first end 192. In the exemplary embodiment, each respective body portion includes a first hook 200 and a second hook 202 that are coupled to first end 192, and at least one third hook 204 that is coupled to second end 194. In the exemplary embodiment, body portion 190, first hook 200, second hook 202, and third hook 204 are formed as a unitary clip. More specifically, in the exemplary embodiment, first and second retaining clips 106 and 108 are fabricated from a single metallic component that is bent to form first hook 200, second hook 202, and third hook 204. In an alternative embodiment, first and second retaining clips 106 and 108 are fabricated as a single unitary component rather than two separate retaining clips. In the exemplary embodiment, first and second retaining clips 106 and 108 are coupled to actuation ring 84 to facilitate securing pins 136 and 138 within respective openings 130 and 132.

During assembly, articulating block 104 is then positioned at least partially into recess 110 formed within actuation ring 84. To facilitate coupling articulating block 104 to actuation ring 84, pin 136 is inserted through first opening 130 until pin 136 is positioned at least partially within second recess 170. Moreover, pin 138 is inserted through second opening 132 until pin 138 is positioned at least partially within third recess 172. In the exemplary embodiment, coupling articulating block 104 to actuation ring 84 utilizing retaining pins 136 and 138 facilitates articulating block 104 moving, or rocking, within recess 110. First and second clips 106 and 198 are then coupled to actuation ring 84 to facilitate securing retaining pins 136 and 138 within openings 130 and 132, respectively. More specifically, first and second hooks 200 and 202 are coupled to actuation ring upper surface 120, and third hook 204 is coupled to actuation ring lower surface 122 such that pins 136 and 138 are secured within openings 130 and 132, respectively. Lever arm first end 86 is then coupled to a respective variable vane 74, and lever arm second end 88 is coupled to actuation ring 84. More specifically, pin 90 is inserted at least partially into first recess 160 such that lever arm second end 88 is rotatably coupled to articulating block 104.

Figure 11:
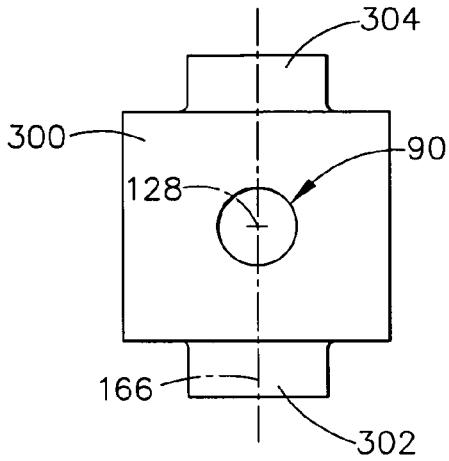
FIG. 11 is a top view of an articulating block shown in FIG. 10.
Figure 12:
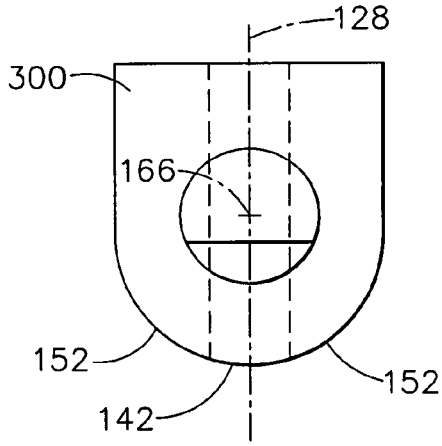
FIG. 12 is a side view of the articulating block shown in FIG. 10.
Figure 9:
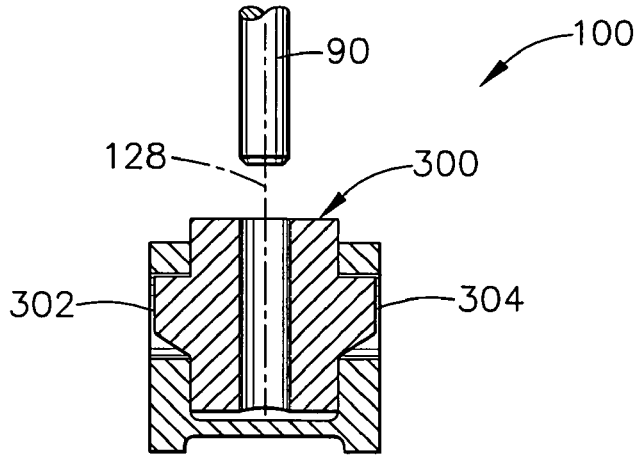
FIG. 9 is a cross-sectional view of an a portion of an exemplary stator lever arm assembly that can be used with the gas turbine shown in FIG. 1.
Figure 10:
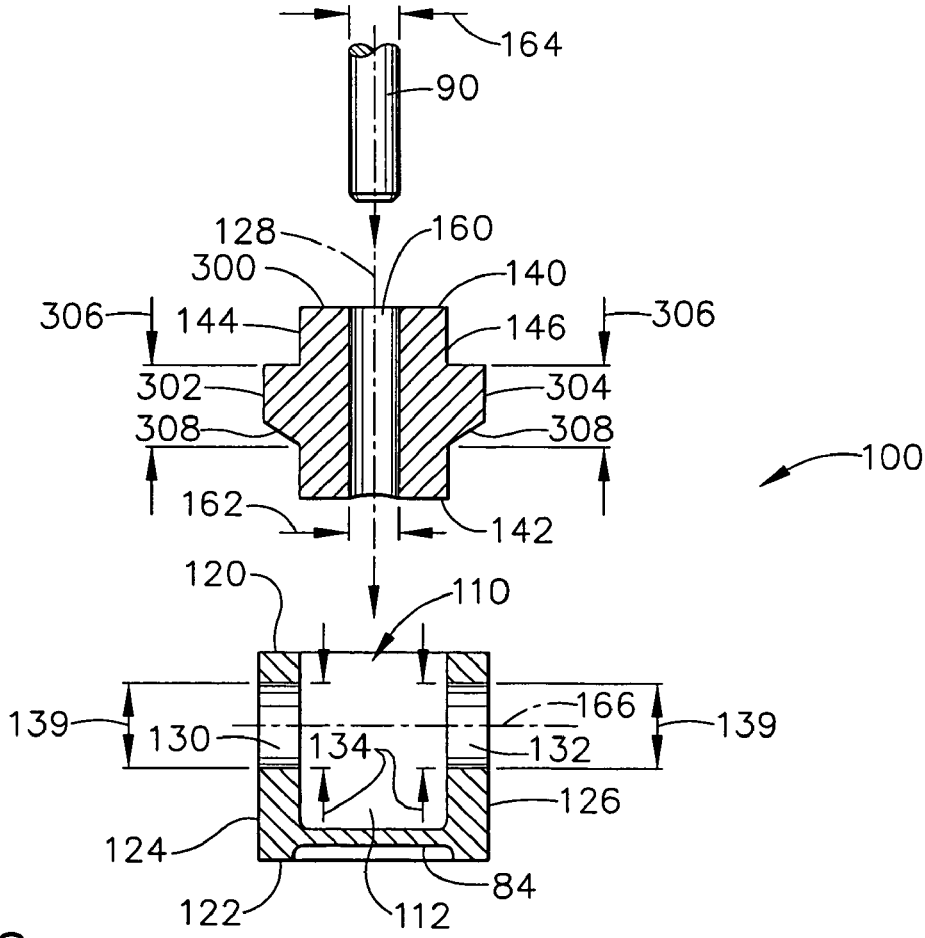
FIG. 10 is an exploded cross-sectional view of the exemplary stator lever arm assembly shown in FIG. 9.

FIG. 9 is a cross-sectional view of an a portion of exemplary stator lever arm assembly 100 that includes an exemplary articulating block 300. FIG. 10 is an exploded cross-sectional view of the exemplary stator lever arm assembly shown in FIG. 9. FIG. 11 is a top view of articulating block 300 shown in FIG. 10. FIG. 12 is a side view of articulating block 300 shown in FIG. 10.

Articulating block 300 is substantially similar to articulating block 104. Accordingly, features shown in articulating block 300 that are similar to features shown in articulating block 104 are identified using the same numbers.

In the exemplary embodiment, articulating block 300 includes upper surface 140, lower surface 142 that is opposite upper surface 140, first side 144, second side 146 that is opposite first side 144, third side 148 (not shown), and fourth side 150 (not shown) that is opposite third side 148. Accordingly, and in the exemplary embodiment, articulating block 300 has a substantially rectangular cross-sectional profile that is substantially similar to the cross-sectional profile of recess 110. More specifically, articulating block 300 has a cross-sectional profile that is selected such that articulating block 300 can be positioned at least partially within recess 110 and move within recess 110. In the exemplary embodiment, articulating block 300 is fabricated from a thermoplastic polyimide material such as, but not limited to, Vespel, for example.

In the exemplary embodiment, articulating block 300 also includes a first tab 302 that extends outwardly from first side 144, and a second tab 304 that extends outwardly from second side 146. In the exemplary embodiment, first and second tabs 302 and 304 have a diameter 306 that is sized such that tabs 302 and 304 can be inserted into openings first and second openings 130 and 132, respectively. In the exemplary embodiment, first and second tabs 302 and 304 each include a lower surface 308 that is fabricated and/or machined such that at least a portion of lower surface is rounded over to coupling articulating block 300 to actuation ring 84, and such that tabs 302 and 304 are substantially aligned along the same horizontal axis 166.

In the exemplary embodiment, as shown in FIG. 12, articulating block lower surface 142 includes two rounded edges 152 such that at least a portion of lower surface has a substantially semi-circular shaped. More specifically, articulating block 300 is fabricated and/or machined such that at least a portion of articulating block lower surface 142 is rounded over to facilitate articulating block 300 moving and/or "rocking" within recess 110.

During assembly, articulating block 300 is "pressed" into recess 110 until tabs 132 and 134 are positioned at least partially into respective openings 130 and 132 formed through actuation ring 84. More specifically, tabs 130 and 132 facilitate coupling articulating block 300 to actuation ring 84 and also facilitate articulating block 300 moving, or rocking, within recess 110. Lever arm first end 86 is then coupled to a respective variable vane 74, and lever arm second end 88 is coupled to actuation ring 84. More specifically, pin 90 is inserted at least partially into first recess 160 such that lever arm second end 88 is rotatably coupled to articulating block 300.

During operation, actuation ring 84 is translated around an engine rotation axis 92. Since lever arm 80 is coupled to actuation ring 84 utilizing articulating block 104 or articulating block 300, translating actuation ring 84 about engine rotation axis 92 causes lever arm 80 to move vane stem 76, and thus variable vane 74 to facilitate positioning variable stator vane 74 in a plurality of orientations to direct air flow through compressor 14. More specifically, since articulating blocks 104 and 300 are fabricated using an anti-friction material, which provides a bushing-to-fixed-pin anti-friction joint, articulating block 104 articulates within actuation ring 84 to facilitate reducing and/or eliminating moment created by the actuation ring rotation about the engine axis and the lever rotation about an axis normal to the engine.

The above-described variable stator vane assembly is cost-effective and highly reliable. The stator vane assembly includes an articulating block that facilitates reducing and/or eliminating moment created by the actuation ring rotation about the engine axis and the lever rotation about an axis normal to the engine. As a result, the bushing binding load at the pin end of the lever and actuation ring is eliminated, thus eliminating potential premature wear out and eventual metal to metal contact between the lever pin and the actuation ring. Pin bushing failure increases actuation ring hysteresis, reduces stall margin, and also reduces peak efficiency of the gas turbine engine.

While the invention has been described in terms of various specific embodiments, those skilled in the art will recognize that the invention can be practiced with modification within the spirit and scope of the claims.

What is claimed is:

1. A method for assembling a variable stator vane assembly, the variable stator vane assembly including an actuation ring, a plurality of variable stator vanes, and a lever arm assembly coupled between the actuation ring and at least one variable stator vane, the lever arm assembly including a lever arm and an articulating block, the actuation ring including an upper surface, a lower surface, a first side, and a second side said method comprising:

inserting an articulating block at least partially into a first recess formed within the actuation ring such that the articulating block is movable in a first axis; and coupling the articulating block to the lever arm such that the lever arm is movable in a second axis that is different than the first axis.

2. A method in accordance with claim 1, wherein the actuation ring also includes a first opening that extends from the actuation ring first side to the actuating ring recess, and a second opening that extends from the actuation ring second side to the actuation ring recess, said method further comprising:

inserting a first retaining pin through the first opening such that the first retaining pin is at least partially inserted into the articulating block; and inserting a second retaining pin through the second opening such that the second retaining pin is at least partially inserted into the articulating block and such that the articulating block is movable in the first axis that is perpendicular to the second axis.

3. A method in accordance with claim 1 wherein the articulating block includes a first recess, a second recess, and a third recess, said method further comprising:

inserting a pin having a first end into the lever arm; and inserting the pin having a second end into the articulating block first recess such that the lever arm is movably coupled to the articulating block.

4. A method in accordance with claim 1 wherein the actuation ring further includes a first opening that extends from the actuation ring first side to the actuation ring recess, and a second opening that extends from the actuation ring second side to the actuation ring recess, said method further comprising:

inserting a first pin through the first opening and at least partially into the second recess; and inserting a second pin through the second opening and at least partially into the third recess, such that the articulating block is movably coupled to the actuation ring.

5. A method in accordance with claim 4 further comprising:

coupling a first retaining clip to the actuation ring to facilitate securing the first pin within the first opening; and coupling a second retaining clip to the actuation ring to facilitate securing the second pin within the second opening.

6. A method in accordance with claim 1 wherein the actuation ring also includes a first opening that extends from the actuation ring first side to the actuating ring recess, and a second opening that extends from the actuation ring second side to the actuation ring recess, and the articulating block includes a first tab and a second tab, said method further comprising:

coupling the articulating block to the actuation ring such that the first tab extends at least partially into the first opening and the second tab extends at least partially into the second opening.

7. A variable stator vane assembly comprising:

an actuation ring including an upper surface, a lower surface, a first side, a second side, and at least one recess that is defined between said upper surface, said lower surface, said first side, and said second side;

a plurality of variable stator vanes; and a lever arm assembly coupled between said actuation ring and at least one of said variable stator vanes, said lever arm assembly comprising:

an articulating block inserted at least partially into said actuation ring recess such that said articulating block is movable in a first axis; and a lever arm coupled to said articulating block and at least one of said variable stator vanes such that said lever arm is movable in a second axis that is different than the first axis.

8. A variable stator vane assembly in accordance with claim 7 wherein said articulating block includes a first recess, a second recess, and a third recess, said variable stator vane assembly further comprising:

a pin having a first end and a second end, said pin first end coupled to said lever arm, said pin second end inserted at least partially into said articulating block first recess such that said lever arm is movably coupled to said articulating block.

9. A variable stator vane assembly in accordance with claim 7 wherein said actuation ring further comprises:

a first opening that extends from said actuation ring first side to said recess; and a second opening that extends from said actuation ring second side to said recess.

10. A variable stator vane assembly in accordance with claim 9 further comprising:

a first pin that extends through said first opening and at least partially into said second recess; and a second pin that extends through said second opening and at least partially into said third recess, such that said articulating block is movably coupled to said actuation ring.

11. A variable stator vane assembly in accordance with claim 10 further comprising:

a first retaining clip configured to secure said first pin within said first opening; and a second retaining clip configured to secure said second pin within said second opening.

12. A variable stator vane assembly in accordance with claim 11 wherein said first and second retaining clips are formed as a single unitary retaining clip.

13. A variable stator vane assembly in accordance with claim 8 wherein said articulating block comprises a lower surface that is rounded to facilitate said articulating blocking moving within said actuation ring recess.

14. A variable stator vane assembly in accordance with claim 9 wherein said articulating block comprises a first tab that is configured to extend at least partially into said first opening and a second tab that is configured to extend at least partially into said second opening, said first and second tabs configured to couple said articulating block to said actuation ring;

a first opening that extends from said actuation ring first side to said recess; and a second opening that extends from said actuation ring second side to said recess.

15. A gas turbine engine comprising a compressor, a combustor, a turbine, and a variable stator vane assembly comprising:

an actuation ring including an upper surface, a lower surface, a first side, a second side, and at least one recess that is defined between said upper surface, said lower surface, said first side, and said second side;

a plurality of variable stator vanes; and a lever arm assembly coupled between said actuation ring and at least one of said variable stator vanes, said lever arm assembly comprising:

an articulating block inserted at least partially into said actuation ring recess such that said articulating block is movable in a first axis; and a lever arm coupled to said articulating block and at least one of said variable stator vanes such that said lever arm is movable in a second axis that is different than the first axis.

16. A gas turbine engine in accordance with claim 15 wherein said articulating block includes a first recess, a second recess, and a third recess, said variable stator vane assembly further comprising:

a pin having a first end and a second end, said pin first end coupled to said lever arm, said pin second end inserted at least partially into said articulating block first recess such that said lever arm is movably coupled to said articulating block.

17. A gas turbine engine in accordance with claim 15 wherein said lever arm assembly further comprises:

a first opening that extends from said actuation ring first side to said recess;

a second opening that extends from said actuation ring second side to said recess;

a first pin that extends through said first opening and at least partially into said second recess; and a second pin that extends through said second opening and at least partially into said third recess, such that said articulating block is movably coupled to said actuation ring.

18. A gas turbine engine in accordance with claim 17 wherein said lever arm assembly further comprises:

a first retaining clip configured to secure said first pin within said first opening; and a second retaining clip configured to secure said second pin within said second opening.

19. A gas turbine engine in accordance with claim 17 wherein said articulating block comprises a lower surface that is rounded to facilitate said articulating blocking moving within said actuation ring recess.

20. A gas turbine engine in accordance with claim 15 wherein said lever arm assembly further comprises:

a first opening that extends from said actuation ring first side to said recess;

a second opening that extends from said actuation ring second side to said recess; and an articulating block comprising a first tab that is configured to extend at least partially into said first opening and a second tab that is configured to extend at least partially into said second opening, said first and second tabs configured to couple said articulating block to said actuation ring.

* * * * *